US008057167B2

(12) United States Patent
Suzuki et al.

(10) Patent No.: US 8,057,167 B2
(45) Date of Patent: Nov. 15, 2011

(54) FAN MOTOR

(75) Inventors: Atsushi Suzuki, Aichi-ken (JP); Takayuki Kobayashi, Aichi-ken (JP); Kazuyuki Kamiya, Aichi-ken (JP); Yuuko Enya, Aichi-ken (JP); Takahisa Hirano, Aichi-ken (JP)

(73) Assignee: Mitsubishi Heavy Indusries, Ltd., Tokyo (JP)

( * ) Notice: Subject to any disclaimer, the term of this patent is extended or adjusted under 35 U.S.C. 154(b) by 554 days.

(21) Appl. No.: 12/304,349

(22) PCT Filed: Sep. 17, 2008

(86) PCT No.: PCT/JP2008/066718

§ 371 (c)(1), (2), (4) Date: Dec. 11, 2008

(87) PCT Pub. No.: WO2009/038067

PCT Pub. Date: Mar. 26, 2009

(65) Prior Publication Data

US 2010/0158713 A1 Jun. 24, 2010

(30) Foreign Application Priority Data

Sep. 21, 2007 (JP) ..... 2007-245107

(51) Int. Cl.
*F01D 11/00* (2006.01)
*F03B 11/00* (2006.01)

(52) U.S. Cl. ..... 415/175; 415/177; 415/220

(58) Field of Classification Search ..... 415/175, 415/220, 177

See application file for complete search history.

(56) References Cited

U.S. PATENT DOCUMENTS 5,180,279 A * 1/1993 McLane-Goetz et al. .... 415/177

(Continued)

FOREIGN PATENT DOCUMENTS

JP 62-799 U 1/1987

(Continued)

OTHER PUBLICATIONS

International Search Report Issued Oct. 14, 2008 in Corresponding International Application No. PCT/JP2008/066718.

*Primary Examiner* — Nitin Parekh

(74) *Attorney, Agent, or Firm* — Westerman, Hattori, Daniels & Adrian, LLP

(57) ABSTRACT

The present invention provides a fan motor capable of achieving both an improvement in a self cooling function of the fan motor and a reduction in fan noise, and of preventing the occurrence of heat damage, problems, and the like caused by external radiation heat and by self-heating, fan noise, and deterioration in fan performance and in fan efficiency. The fan motor (1) includes: a shroud (2); a motor (3) secured to and supported at the shroud (2); an axial-flow fan (4) connected to a rotation shaft part of the motor (3); and a heat shield panel (5) mounted at the rear side of the motor (3) with a gap being provided therebetween, in which the heat shield panel (5) has a spatula-shaped air guiding part (52) projecting outward in a radial direction at least one location on an outer circumference portion; and the air guiding part (52) has a width gradually reducing toward an outer side and a fan-rotational-direction leading edge part (53) having an arc shape.

11 Claims, 6 Drawing Sheets

U.S. PATENT DOCUMENTS

| | | | | |
|---|---|---|---|---|
| 7,478,992 | B2 * | 1/2009 | Hsu et al. | 415/184 |
| 2006/0147322 | A1 * | 7/2006 | Lee | 417/366 |
| 2007/0031250 | A1 * | 2/2007 | Suzuki et al. | 415/220 |
| 2008/0075585 | A1 * | 3/2008 | Acre | 415/177 |
| 2011/0008170 | A1 * | 1/2011 | Suzuki et al. | 416/191 |

FOREIGN PATENT DOCUMENTS

| | | | |
|---|---|---|---|
| JP | 4-103298 | U | 9/1992 |
| JP | 2003-166498 | A | 6/2003 |
| JP | 2007-040200 | A | 2/2007 |
| JP | 2007-247603 | A | 9/2007 |

* cited by examiner

FAN MOTOR

TECHNICAL FIELD

The present invention relates to a fan motor in which a fan and a motor are combined and which is used to cool a radiator, a condenser, and the like for a vehicle.

BACKGROUND ART

In a vehicle having an air conditioner, a radiator which cools coolant for the engine and a condenser for the air conditioner may be combined and installed in the engine compartment located behind a front grill of the vehicle. In the radiator and the condenser, a fan motor obtained by combining a fan and a motor is included to let cooling air flow. The fan motor generally includes a plastic shroud which has an opening for letting air in and a motor holding part supported by a plurality of support struts at a center portion of the opening; a compact motor which is secured to and supported at the motor holding part of the shroud; and a plastic axial-flow fan which has a hub part connected to a rotation shaft part of the motor and which has a plurality of fan blades on the outer circumference of the hub part.

Since all parts of the fan motor, including the motor, are usually installed in a high-temperature environment in the engine compartment, they may be thermally affected by the engine, serving as a heat source, and have an abnormally high temperature. This may cause deterioration in the motor properties, a reduction in life, or the like, and lead to looseness of bolts in a motor securing part and to thermal deformation or melting of a motor supporting part, when the shroud for supporting the motor is made of plastic. Therefore, countermeasures have conventionally been employed, such as improving the heat resistance of the motor itself, using a metal shroud, adding a metal heat-shield panel at the rear of the motor to shield the motor from radiation heat from the engine side, and providing a spatula-shaped air guiding panel projecting into an air flow passage to let in cooling air in the vicinity of the motor for forced-cooling (see Patent Document 1, for example).

Patent Document 1: Japanese Unexamined Patent Application, Publication No. 2007-40200

DISCLOSURE OF INVENTION

However, when a further increase in temperature in the vicinity of the fan motor is caused by the high density in the engine compartments of recent vehicles, the above-mentioned countermeasures may be insufficient for cooling. In other words, since the fan motor is disposed closer to a high temperature part, the influence of radiation heat becomes increasingly larger. The motor itself also generates heat, and therefore, more effective countermeasures against heat are required. If heat measures and cooling measures are insufficient, a problem may occur due to heat damage, the cost and weight may increase, and in addition, fan noise may increase, and fan performance and fan efficiency may deteriorate.

In view of the above-described circumstances, the present invention has been made, and therefore, it is an object of the present invention to provide a fan motor capable of achieving both an improvement in a self cooling function of the fan motor and a reduction in fan noise, and of preventing the occurrence of heat damage, problems, and the like caused by external radiation heat and by self-heating, fan noise, and deterioration in fan performance and in fan efficiency.

The fan motor of the present invention employs the following solutions in order to solve the above-described problems.

According to the present invention, there is provided a fan motor including: a shroud which has an opening for letting air in and a motor holding part supported by a plurality of support struts at a center portion of the opening; a motor which is secured to and supported at the motor holding part of the shroud; an axial-flow fan which has a hub part connected to a rotation shaft part of the motor, and has a plurality of fan blades on an outer circumference of the hub part; and a heat shield panel which is mounted at a rear side of the motor with a gap being provided therebetween, in which the heat shield panel has a spatula-shaped air guiding part projecting outward in a radial direction, at least one location on an outer circumference portion thereof; and the air guiding part has a width which gradually reduces toward an outer side and a fan-rotational-direction leading edge part which has an arc shape.

According to the present invention, the spatula-shaped air guiding part projecting from the outer circumference portion of the heat shield panel has a shape in which the width gradually reduces toward the outer side, is narrow at the outer side at which the circumferential speed of the fan is high, and is wide at the inner side at which the circumferential speed of the fan is low. Therefore, discrete frequency noise caused by pressure interference between the air guiding part and the fan blades can be reduced. Further, since the fan-rotational-direction leading edge part of the air guiding part has an arc shape, the direction of outlet air blown out from the axial-flow fan can be gradually changed to be guided to the center side in the radial direction of the heat shield panel and efficiently guided to the inner face side of the heat shield panel. Accordingly, cooling air can be effectively guided between the motor and the heat shield panel to improve the cooling effect in the vicinity of the motor. Therefore, it is possible to achieve both an improvement in a self cooling function of the fan motor and a reduction in fan noise, and to reliably prevent the occurrence of heat damage, problems, and the like caused by external radiation heat and by self-heating, fan noise, and deterioration in fan performance and in fan efficiency.

Further, according to the present invention, in the fan motor described above, the air guiding part may have a fan-rotational-direction trailing edge part which has a straight shape.

According to the present invention, the fan-rotational-direction trailing edge part has a straight shape, so that the air guiding part can have a required area while narrowing the width of the air guiding part at the outer side (at the tip end side). Therefore, cooling air having a necessary and sufficient volume can be guided to the inner face side of the heat shield panel to improve the cooling effect in the vicinity of the motor.

Furthermore, according to the present invention, in any one of the fan motors described above, the fan-rotational-direction leading edge part of the air guiding part may have a guide part bent toward an upstream side in an air flow direction, and the fan-rotational-direction trailing edge part of the air guiding part may have a guide part bent toward a downstream side in the air flow direction.

According to the present invention, outlet air blown out from the axial-flow fan can be guided to the air guiding part by the guide part provided on the fan-rotational-direction trailing edge part of the air guiding part, and the guided air can be prevented from passing through by the guide part provided on the fan-rotational-direction leading edge part. Accordingly, acquisition of the outlet air is improved, thereby allowing cooling air to be effectively guided to the inner face side of the heat shield panel. Therefore, cooling air having a necessary and sufficient volume can be guided to the inner face side of the heat shield panel to improve the cooling effect in the vicinity of the motor.

Furthermore, according to the present invention, in any one of the fan motors described above, the air guiding part may be provided at each of two or more locations on the outer circumference portion of the heat shield panel.

According to the present invention, when cooling performance needs to be improved in order to cope with an increase in capacity of the fan motor or an increase in installation environment temperature, the cooling performance can easily be increased by providing the air guiding part at each of two or more locations on the outer circumference portion of the heat shield panel. Therefore, the demand can be easily satisfied.

Furthermore, according to the present invention, in any one of the fan motors described above, a pitch angle of the air guiding part provided at each of two or more locations is set to a non-integer multiple of a pitch angle of the fan blades.

According to the present invention, when the air guiding part is provided at each of two or more locations, a pitch angle thereof is set to a non-integer multiple of the pitch angle of the fan blades of the axial-flow fan. It is thus possible to avoid an increase in discrete frequency noise caused by pressure interference in a specific frequency band. Therefore, an increase in cooling performance can be achieved while reliably suppressing fan noise.

Furthermore, according to the present invention, in any one of the fan motors described above, the heat shield panel may have an arc-shaped guide part bent toward a downstream side in the air flow direction, on an outer circumference edge portion, except the air guiding part.

According to the present invention, with the arc-shaped guide part provided on the outer circumference edge portion of the heat shield panel, cooling air which is guided to the inner face side of the heat shield panel and is then blown out from the outer circumference portion thereof and outlet air blown out from the axial-flow fan can be smoothly combined and made to flow toward the downstream side. Therefore, it is possible to increase the volume of cooling air, to improve self-cooling performance, and to prevent the occurrence of noise caused by turbulence of the outlet air.

Furthermore, according to the present invention, in any one of the fan motors described above, the heat shield panel may have, on the outer circumference portion, a conical slope starting at a center portion of the heat shield panel toward a windward side in the air flow direction.

According to the present invention, with the conical slope provided on the outer circumference portion of the heat shield panel, the cross-sectional area of the gap between the rear of the motor and the heat shield panel can be gradually reduced toward the outer circumference portion, so that cooling air guided to the inner face side of the heat shield panel by the air guiding part can be blown out from the outer circumference portion of the heat shield panel without reducing its speed. Therefore, self-cooling performance can be improved by suppressing an increase in pressure at the inner face side of the heat shield panel and achieving an increase in volume of cooling air.

Furthermore, according to the present invention, in any one of the fan motors described above, the heat shield panel may be mounted in a direction in which the fan-rotational-direction leading edge part, having the arc shape, of the air guiding part is disposed at a leading side of the axial-flow fan in a rotational direction thereof, and the fan-rotational-direction trailing edge part, having the straight shape, of the air guiding part is disposed at a trailing side of the axial-flow fan in a rotational direction thereof.

According to the present invention, the outlet air blown out by the rotation of the axial-flow fan can be deflected toward the center side in the radial direction of the heat shield panel to be efficiently guided to the inner face side of the heat shield panel as cooling air for the fan motor, by the air guiding part, in which the fan-rotational-direction leading edge part has an arc shape, the fan-rotational-direction trailing edge part has a straight shape, and the width thereof gradually reduces toward the outer side. Therefore, while discrete frequency noise caused by pressure interference between the air guiding part and the fan blades is being suppressed, cooling air can be effectively guided between the motor and the heat shield panel to improve the cooling effect in the vicinity of the motor. It is thus possible to achieve both an improvement in a self cooling function of the fan motor and a reduction in fan noise, and to reliably prevent the occurrence of heat damage, problems, and the like caused by external radiation heat and by self-heating, fan noise, and deterioration in fan performance and in fan efficiency.

Furthermore, according to the present invention, in any one of the fan motors described above, the heat shield panel may be mounted such that the air guiding part is disposed at a location where the air guiding part is overlapped with at least one of the support struts of the shroud.

According to the present invention, since the air guiding part is disposed at a location where the air guiding part is overlapped with at least one of the support struts of the shroud, the air guiding part can shield some of the support struts constituting the shroud from heat. Therefore, a heat shielding function of the heat shield panel can be further enhanced.

Furthermore, according to the present invention, in any one of the fan motors described above, the heat shield panel may be mounted such that the air guiding part is disposed between the support struts of the shroud.

According to the present invention, since the air guiding part is disposed between the support struts of the shroud, outlet air blown out from the axial-flow fan can be guided to the inner face side of the heat shield panel by the air guiding part without being impeded by the support struts. Therefore, cooling air having a necessary and sufficient volume can be guided to the inner face side of the heat shield panel, thereby improving the cooling effect in the vicinity of the motor.

Furthermore, according to the present invention, in any one of the fan motors described above, a securing part for the motor and/or the heat shield panel secured to and supported at the motor holding part is provided at a location closer to an inner circumference side than the outer circumference portion of the heat shield panel.

According to the present invention, since the securing parts (securing bolts and the like) for the motor and/or the heat shield panel secured to and supported at the motor holding part are provided at locations closer to the inner circumference side than the outer circumference portion of the heat shield panel, the securing parts for the heat shield panel itself, which is exposed to a heat source, and for the motor, which generates heat by itself, can be effectively cooled by cooling air guided to the inner face side of the heat shield panel. Therefore, it is possible to reliably prevent the occurrence of heat damage and problems caused by external radiation heat and by self-heating.

According to the present invention, while discrete frequency noise caused by pressure interference between the air guiding part and the fan blades is being suppressed, cooling air can be effectively guided between the motor and the heat shield panel to further improve the cooling effect in the vicinity of the motor. It is thus possible to achieve both an improvement in a self cooling function of the fan motor and a reduction in fan noise, and to reliably prevent the occurrence of heat damage, problems, and the like caused by external radiation heat and by self-heating, fan noise, and deterioration in fan performance and in fan efficiency.

EXPLANATION OF REFERENCE SIGNS

Figure 1:
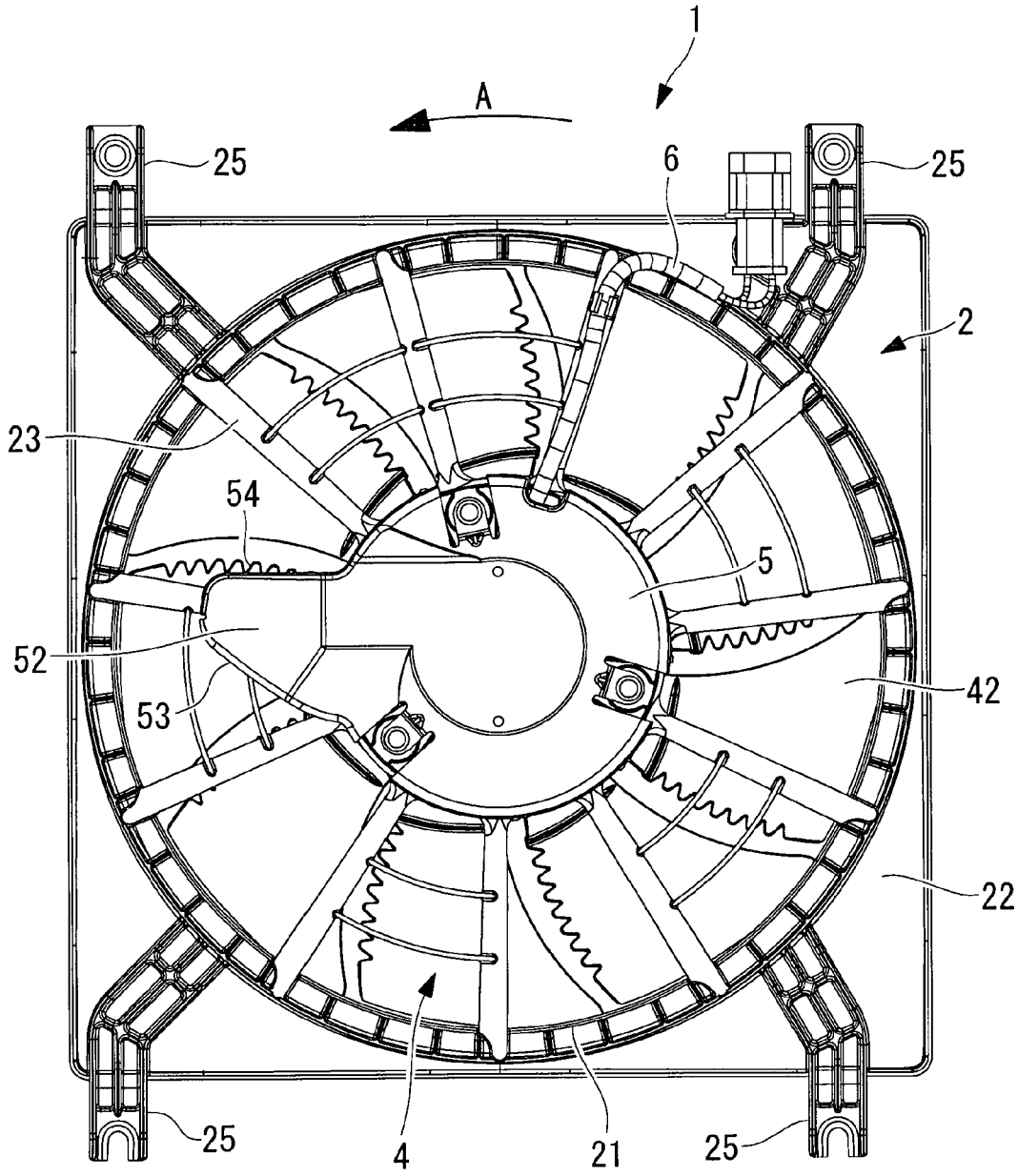
FIG. 1 is a side view of a fan motor according to a first embodiment of the present invention when seen from a heat shield panel side.

1: fan motor
2: shroud
3: motor
4: axial-flow fan
5: heat shield panel
21: opening
23: support strut
24: motor holding part
31: rotation shaft part
41: hub part
42: fan blade
51: gap
52: air guiding part
53: fan-rotational-direction leading edge part
54: fan-rotational-direction trailing edge part
56: guide part
57: guide part
58: arc-shaped guide part
59: slope
60: securing part

BEST MODE FOR CARRYING OUT THE INVENTION

Hereinafter, embodiments of the present invention will be described with reference to the drawings.

First Embodiment

Hereinafter, a first embodiment of the present invention will be described with reference to FIGS. 1 to 3.

FIG. 1 is a side view of a fan motor 1 according to the first embodiment of the present invention when seen from a heat shield panel side. FIG. 2 is a longitudinal sectional view of a center portion of the fan motor 1.

The fan motor 1 includes a shroud 2, a compact electric motor 3 (see FIG. 2) which is secured to and supported at a center portion of the shroud 2, an axial-flow fan 4 which is rotated and driven by the motor 3, and a heat shield panel 5 which shields the rear side of the motor 3 from heat.

As shown in FIG. 1, the shroud 2 includes a square-shaped frame-like main body 22 which has an opening 21 for letting air in, a motor holding part 24 (see FIG. 2) which is supported at a center portion of the opening 21 by multiple support struts 23 radially provided on the frame-like main body 22, and mounting legs 25 which are provided at the corners of the frame-like main body 22. The shroud 2 is mounted on the rear side of a radiator and a condenser (which are not shown) by the mounting legs 25 to let air flow through the radiator and the condenser and is a single part formed of heat-resistant glass-reinforced polypropylene plastic (PP).

The motor 3 is a thin disk-like brushless motor and has a rotation shaft part 31 at a center portion thereof. The motor 3 is secured to and supported at the motor holding part 24 of the shroud 2 by securing bolts and the like (not shown).

The axial-flow fan 4 is a plastic propeller fan which has a hub part 41 configured to have a shape that accommodates the motor 3 and which has a plurality of fan blades 42 provided on the outer circumference of the hub part 41, and is a single part formed of heat-resistant glass-reinforced polypropylene plastic (PP). The hub part 41 of the axial-flow fan 4 is connected to the rotation shaft part 31 of the motor 3, and the motor 3 serves as a driving source to rotate and drive the axial-flow fan 4 in the opening 21 of the shroud 2. Note that a desired number of fan blades 42 may be used.

Figure 2:
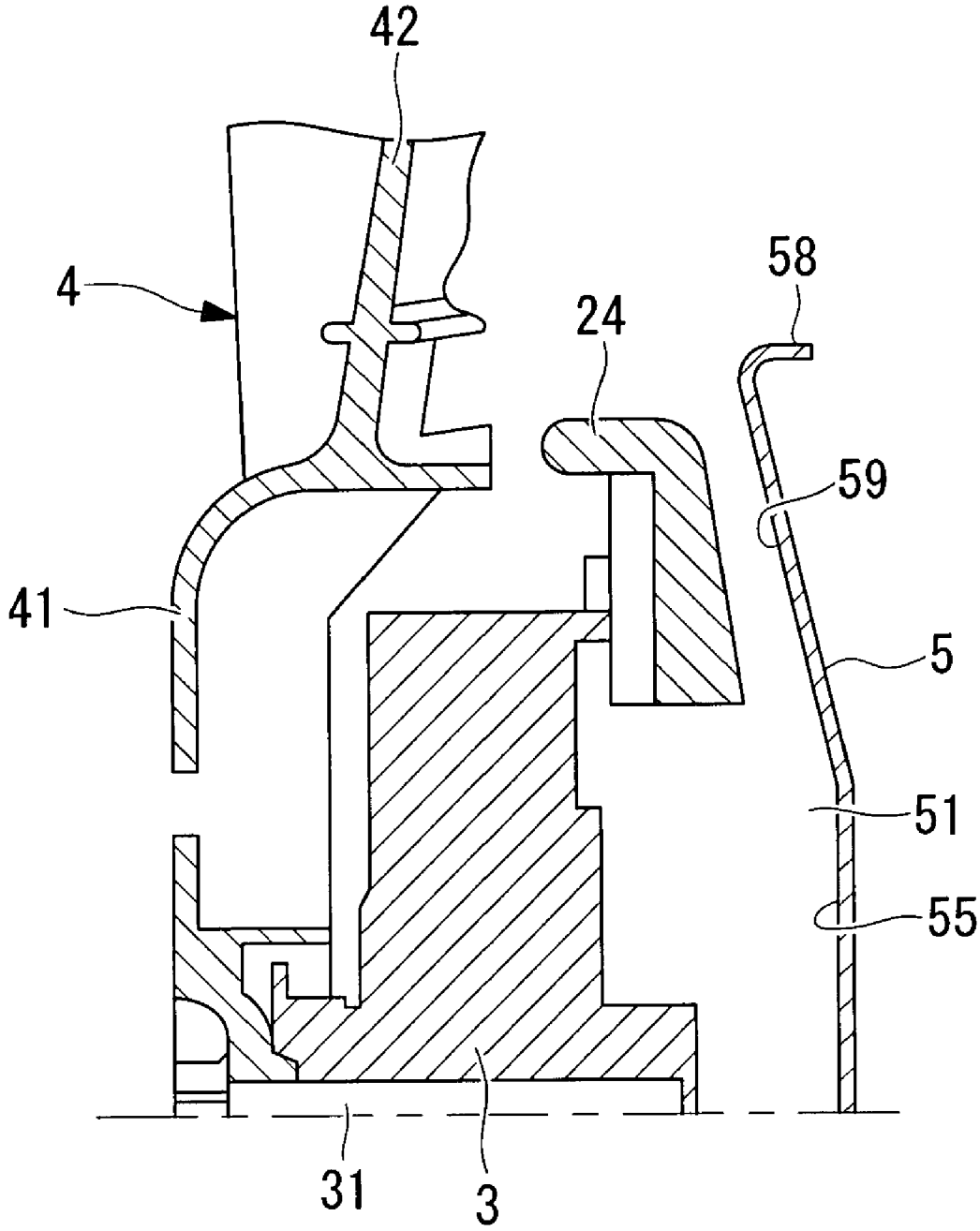
FIG. 2 is a longitudinal sectional view of a center portion of the fan motor shown in FIG. 1.

The heat shield panel 5 is a disc having approximately a circular shape and configured as a thin plate made of metal, and has an outer diameter necessary for covering the rear side of the motor 3 and the outer circumference of the motor holding part 24 of the shroud 2, as shown in FIGS. 1 and 2. The heat shield panel 5 is secured to and supported at the motor holding part 24 of the shroud 2 by securing bolts (not shown) with a predetermined gap 51 being provided at the rear of the motor 3. At one location on the outer circumference of the heat shield panel 5, an air guiding part 52 which has a spatula shape or a rice scoop shape and projects outward in the radial direction is integrally provided.

Figure 3:
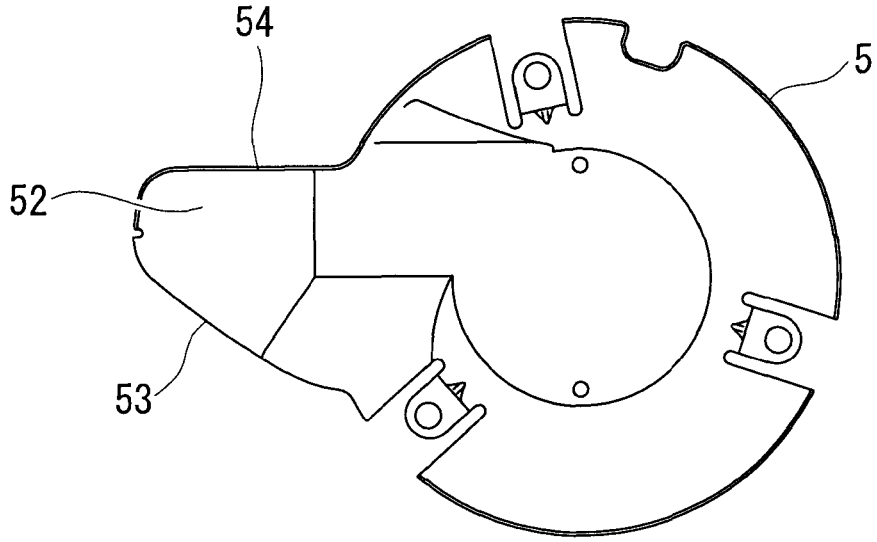
FIG. 3 is a side view of a heat shield panel of the fan motor shown in FIG. 1.

As shown in FIG. 3, the air guiding part 52 has a fan-rotational-direction leading edge part 53 having an arc shape and a fan-rotational-direction trailing edge part 54 having a straight shape. The width of the air guiding part 52 gradually reduces toward the outer side, and tip end parts thereof are smoothly connected with appropriate radii (R). As shown in FIG. 1, the air guiding part 52 is disposed to project into a passage of a flow of outlet air blown out from the axial-flow fan 4.

Further, in the heat shield panel 5, an inner face side ranging from the air guiding part 52 to the center portion of the heat shield panel 5, that is, a face that receives outlet air blown out from the axial-flow fan 4, is formed to have a slightly indented shape 55 (see FIGS. 2 and 4) to easily guide the outlet air to the center side of the heat shield panel 5.

In this embodiment, the motor 3 is supplied with power from a power source via a harness 6, and the harness 6 is wired to the motor 3 along one of the support struts 23 of the shroud 2.

According to this embodiment, the following operational effects are obtained with the above-described configuration.

When the motor 3 rotates and drives the axial-flow fan 4, air taken in from the front of the shroud 2 through the radiator and the condenser is blown out to the rear side of the shroud 2 in the form of a swirling flow. Since the motor 3 itself generates heat due to the rotation and driving, and the fan motor 1 is exposed to a high-temperature environment in the engine compartment, the fan motor 1 receives radiation heat from the engine and the like. Therefore, it is necessary to block the radiation heat and to apply forced-cooling to the vicinity of the motor 3.

In this embodiment, the rear side of the motor holding part 24 of the shroud 2 and the motor 3 is shielded by the heat shield panel 5, so that radiation heat from the engine side can be blocked by the heat shield panel 5 to reduce a thermal load caused by the radiation heat. Part of the outlet air blown out from the axial-flow fan 4 is received by the spatula-shaped air guiding part 52 of the heat shield panel 5, projecting into the passage of the flow of the outlet air, and is guided to the center portion at the inner face side of the heat shield panel 5 through the gap 51 between the heat shield panel 5 and the rear side of the motor 3. Therefore, forced-cooling can be applied to the rear of the motor 3.

The air guiding part 52 has a shape in which the width gradually reduces toward the outer side, is narrow at the outer side at which the circumferential speed of the fan is high, and is wide at the inner side at which the circumferential speed of the fan is low. Therefore, discrete frequency noise caused by pressure interference between the air guiding part 52 and the fan blades 42 of the axial-flow fan 4 can be reduced. Further, since the fan-rotational-direction leading edge part 53 of the air guiding part 52 has a gentle arc shape, the direction of outlet air blown out from the axial-flow fan 4 in the form of a swirling flow can be gradually changed to be guided to the inner face side of the heat shield panel 5. Further, since the inner face side of the air guiding part 52 and the heat shield panel 5, where outlet air is received, is formed to have the slightly indented shape 55, the outlet air can be efficiently guided to the center portion of the inner face side of the heat shield panel 5.

Therefore, cooling air can be effectively guided to the gap 51 between the rear side of the motor 3 and the inner face side of the heat shield panel 5 to improve the cooling effect in the vicinity of the motor 3. Therefore, it is possible to achieve both an improvement in a self cooling function of the fan motor 1 and a reduction in fan noise, and to reliably prevent the occurrence of heat damage, problems, and the like caused by external radiation heat and by self-heating, fan noise, and deterioration in fan performance and in fan efficiency. In forming the air guiding part 52 to have the width gradually reducing toward the outer side, the fan-rotational-direction trailing edge part 54 is made to have a straight shape, so that the air guiding part 52 can have a required area while narrowing the width at the outer side (at the tip end side). Therefore, cooling air having a necessary and sufficient volume can be guided to the inner face side of the heat shield panel 5 to improve the cooling effect in the vicinity of the motor 3.

Second Embodiment

Next, a second embodiment of the present invention will be described with reference to FIG. 4.

This embodiment is different from the first embodiment in that guide parts 56 and 57 are provided on the air guiding part 52. Since the other items are the same as those in the first embodiment, a description thereof will be omitted.

Figure 4:
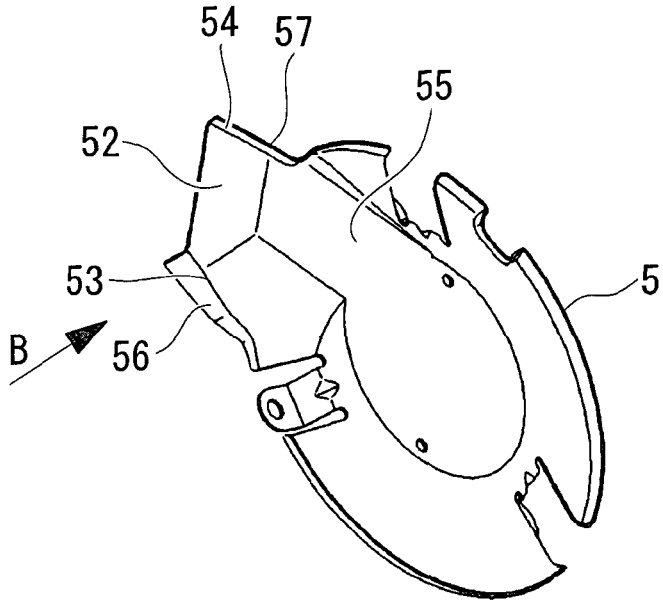
FIG. 4 is a perspective view of a heat shield panel according to a second embodiment of the present invention.

In this embodiment, as shown in FIG. 4, the guide part 56 bent toward the upstream side in an air flow direction B, specifically, in a direction in which outlet air is blown out from the axial-flow fan 4, is provided on the fan-rotational-direction leading edge part 53 of the air guiding part 52, and the guide part 57 bent toward the downstream side in the air flow direction B, specifically, in the direction in which outlet air is blown out from the axial-flow fan 4, is provided on the fan-rotational-direction trailing edge part 54.

With this configuration, outlet air blown out from the axial-flow fan 4 can be guided to the air guiding part 52 by the guide part 57, provided on the fan-rotational-direction trailing edge part 54, and the outlet air guided to the air guiding part 52 can be prevented from passing through by the guide part 56, provided on the fan-rotational-direction leading edge part 53. Accordingly, acquisition of the outlet air is improved, thereby allowing cooling air to be effectively guided to the inner face side of the heat shield panel 5. Therefore, cooling air having a necessary and sufficient volume can be guided to the inner face side of the heat shield panel 5 to improve the cooling effect in the vicinity of the motor 3.

Third Embodiment

Next, a third embodiment of the present invention will be described with reference to FIGS. 5A to 5C.

This embodiment is different from the first and second embodiments in that the air guiding part 52 is provided at each of multiple locations. Since the other items are the same as those in the first and second embodiment, a description thereof will be omitted.

Figure 5A:
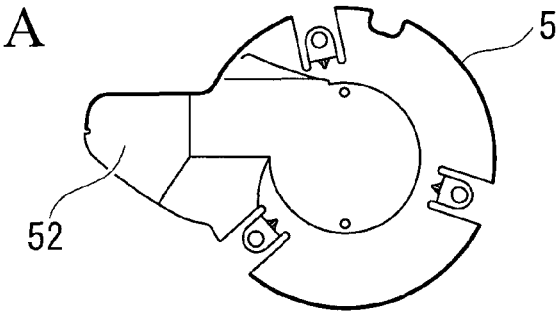
FIG. 5A is a side view of a heat shield panel according to a third embodiment of the present invention.
Figure 5B:
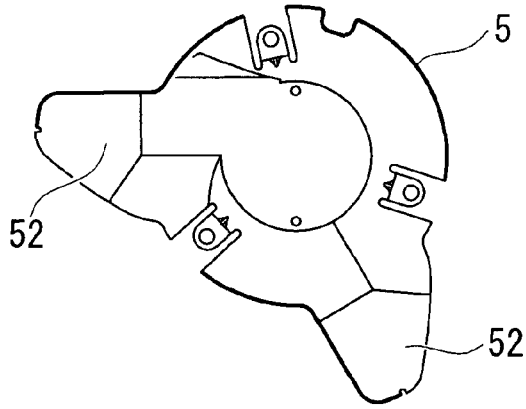
FIG. 5B is a side view of a heat shield panel according to the third embodiment of the present invention.
Figure 5C:
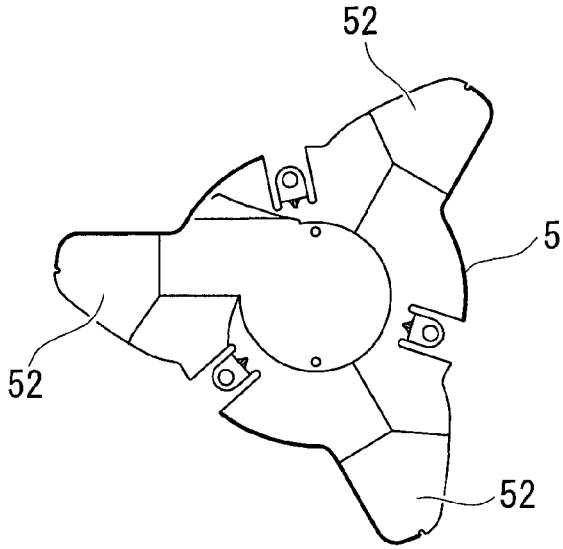
FIG. 5C is a side view of a heat shield panel according to the third embodiment of the present invention.

Whereas the above-described embodiments provide the air guiding part 52 at one location on the outer circumference portion of the heat shield panel 5, as shown in FIG. 5A, this embodiment provides the air guiding part 52 at each of two locations at a predetermined pitch angle, as shown in FIG. 5B or provides the air guiding part 52 at each of three locations at a predetermined pitch angle, as shown in FIG. 5C.

With this configuration, when cooling performance needs to be improved in order to cope with an increase in capacity of the fan motor 1 or an increase in installation environment temperature, the cooling performance can easily be increased by providing the air guiding part 52 at each of two or more locations on the outer circumference portion of the heat shield panel 5 at a predetermined pitch angle. Therefore, if it is necessary to improve the cooling performance, the demand can be easily satisfied.

When the air guiding part 52 is provided at each of two or more locations as described above, it is preferred that the pitch angle thereof be set to a non-integer multiple of the pitch angle of the fan blades 42 of the axial-flow fan 4. For example, when the number of fan blades 42 is eight, the pitch angle of the fan blades 42 is 45 degrees ((360 degrees)/8). Therefore, setting the pitch angle of a plurality of air guiding parts 52 to an integer multiple of 45 degrees (for example, 90 degrees, 180 degrees, or the like) should be avoided. It is thus possible to avoid an increase in discrete frequency noise caused by pressure interference in a specific frequency band, and to achieve an increase in cooling performance while reliably suppressing fan noise.

Fourth Embodiment

Next, a fourth embodiment of the present invention will be described with reference to FIG. 6.

This embodiment is different from the first to third embodiments in that an arc-shaped guide part 58 is provided on an outer circumference edge portion of the heat shield panel 5.

Since the other items are the same as those in the first to third embodiments, a description thereof will be omitted.

Figure 6:
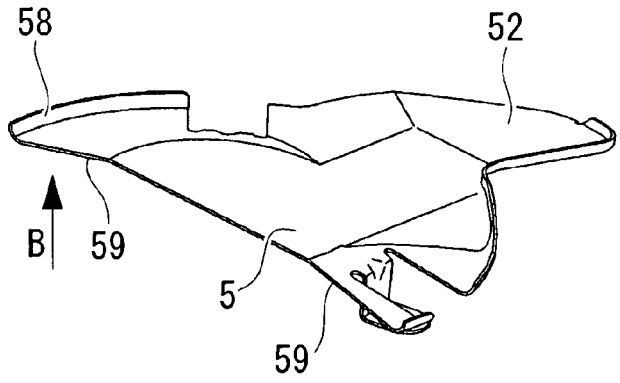
FIG. 6 is a perspective view of a heat shield panel according to fourth and fifth embodiments of the present invention when cut in half at the center portion.

In this embodiment, as shown in FIG. 6, the arc-shaped guide part 58, which is bent toward the downstream side in the air flow direction B, specifically, in the direction in which outlet air is blown out from the axial-flow fan 4, is provided on the outer circumference edge portion, except the air guiding part 52, of the heat shield panel 5 (see also FIG. 2).

When the arc-shaped guide part 58 is provided on the outer circumference edge portion of the heat shield panel 5 as described above, cooling air which is guided to the inner face side of the heat shield panel 5 by the air guiding part 52 to cool the vicinity of the motor 3 and is then blown out from the outer circumference portion thereof and outlet air blown out from the axial-flow fan 4 can be smoothly combined and made to flow toward the downstream side. Therefore, it is possible to increase the volume of cooling air, to improve self-cooling performance, and to prevent the occurrence of noise caused by turbulence of the outlet air.

Fifth Embodiment

Next, a fifth embodiment of the present invention will be described with reference to FIG. 6.

This embodiment is different from the first to fourth embodiments in that a conical slope 59 is provided on an outer circumference portion of the heat shield panel 5. Since the other items are the same as those in the first to fourth embodiments, a description thereof will be omitted.

In this embodiment, as shown in FIG. 6, the conical slope 59, which is relatively gentle, is provided on the outer circumference portion of the heat shield panel 5, from the center portion of the heat shield panel 5 toward a windward side in the air flow direction B, specifically, in the direction in which outlet air is blown out from the axial-flow fan 4 (see also FIG. 2).

When the gentle conical slope 59 is provided on the outer circumference portion of the heat shield panel 5 as described above, the cross-sectional area of the gap 51 between the rear of the motor 3 and the heat shield panel 5 can be gradually reduced toward the outer circumference portion, so that cooling air guided to the inner face side of the heat shield panel 5 by the air guiding part 52 and used to cool the vicinity of the motor 3 can be blown out from the outer circumference portion of the heat shield panel 5 into the air flow passage without reducing its speed. Therefore, self-cooling performance can be improved by suppressing an increase in pressure at the inner face side of the heat shield panel 5 and achieving an increase in volume of cooling air.

Sixth Embodiment

Next, a sixth embodiment of the present invention will be described with reference to FIG. 7.

This embodiment is different from the first to fifth embodiments in that a direction in which the air guiding part 52 is disposed is specified. Since the other items are the same as those in the first to fifth embodiments, a description thereof will be omitted.

Figure 7:
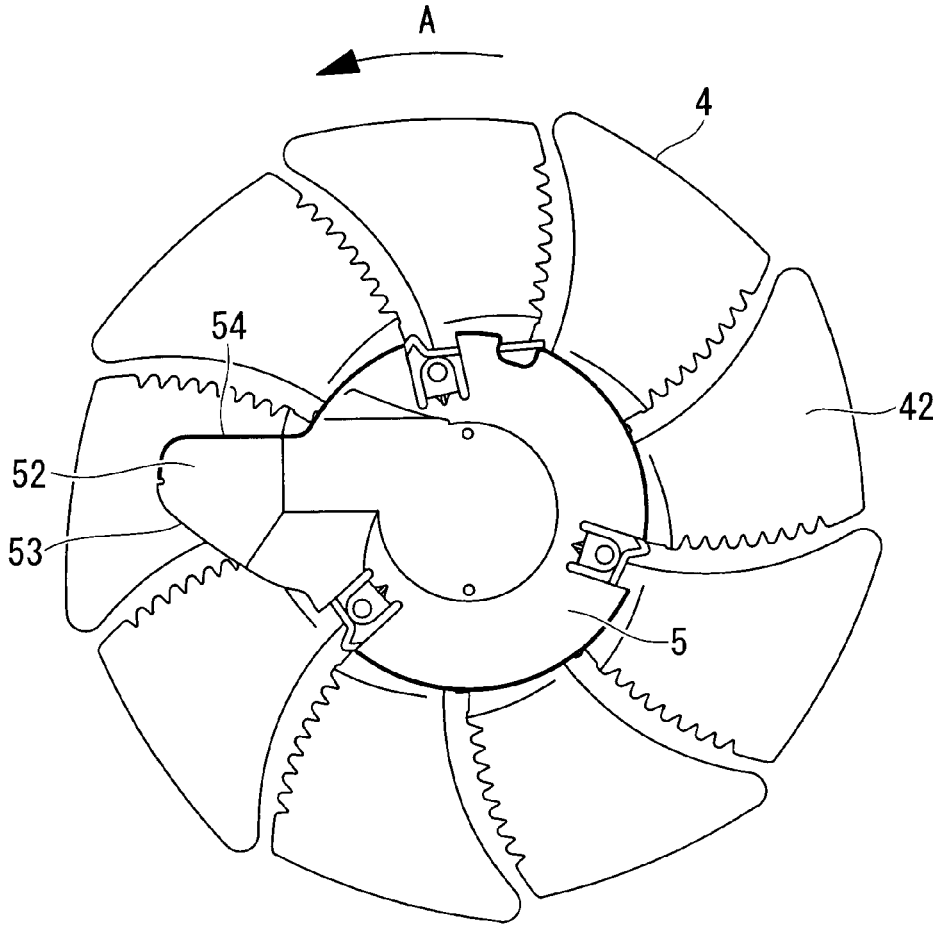
FIG. 7 is a side view of a heat shield panel and an axial-flow fan according to a sixth embodiment of the present invention when seen from a heat shield panel side.

In this embodiment, as shown in FIG. 7, the arc-shaped fan-rotational-direction leading edge part 53 of the air guiding part 52 provided on the heat shield panel 5 is arranged at a rotational-direction leading side with respect to a rotational direction A of the axial-flow fan 4, and the straight-shaped fan-rotational-direction trailing edge part 54 is arranged at a rotational-direction trailing side with respect to the rotational direction A of the axial-flow fan 4.

With this configuration, the outlet air blown out in the form of a swirling flow by the rotation of the axial-flow fan 4 can be deflected toward the center side in the radial direction of the heat shield panel 5 to be efficiently guided to the inner face side of the heat shield panel 5, by the air guiding part 52, in which the fan-rotational-direction leading edge part 53 has an arc shape, the fan-rotational-direction trailing edge part 54 has a straight shape, and the width thereof gradually reduces toward the outer side. Therefore, while discrete frequency noise caused by pressure interference between the air guiding part 52 and the fan blades 42 is being suppressed, outlet air blown out from the axial-flow fan 4 can be effectively guided to the gap 51 between the motor 3 and the heat shield panel 5 as cooling air to improve the cooling effect in the vicinity of the motor 3. It is thus possible to achieve both an improvement in the self cooling function of the fan motor 1 and a reduction in fan noise, and to reliably prevent the occurrence of heat damage, problems, and the like caused by external radiation heat and by self-heating, fan noise, and deterioration in fan performance and in fan efficiency.

Seventh Embodiment

Next, a seventh embodiment of the present invention will be described with reference to FIG. 1.

This embodiment is different from the first to sixth embodiments in that a location where the air guiding part 52 is disposed is specified. Since the other items are the same as those in the first to sixth embodiments, a description thereof will be omitted.

In this embodiment, as shown in FIG. 1, the heat shield panel 5 is secured to and supported at the shroud 2 such that the air guiding part 52 is disposed at a location where the air guiding part 52 is overlapped with at least one of the support struts 23, radially provided on the shroud 2.

When the air guiding part 52 is disposed at a location where the air guiding part 52 is overlapped with at least one of the support struts 23 of the shroud 2, the air guiding part 52 can shield some of the support struts 23 constituting the shroud 2 from heat. Therefore, a heat shielding function, which is a primary function of the heat shield panel 5, can be further enhanced.

Alternatively, the air guiding part 52 of the heat shield panel 5 may be disposed at a location between the multiple support struts 23 of the shroud 2. When the air guiding part 52 is disposed at a location between the multiple support struts 23 of the shroud 2 as described above, outlet air blown out from the axial-flow fan 4 can be guided to the inner face side of the heat shield panel 5 by the air guiding part 52 without being impeded by the support struts 23. Therefore, cooling air having a necessary and sufficient volume can be guided to the inner face side of the heat shield panel 5, thereby improving the cooling effect in the vicinity of the motor 3.

Eighth Embodiment

Next, an eighth embodiment of the present invention will be described with reference to FIG. 8.

This embodiment is different from the first to seventh embodiments in that the securing structure of the heat shield panel 5 is specified. Since the other items are the same as those in the first to seventh embodiments, a description thereof will be omitted.

Figure 8:
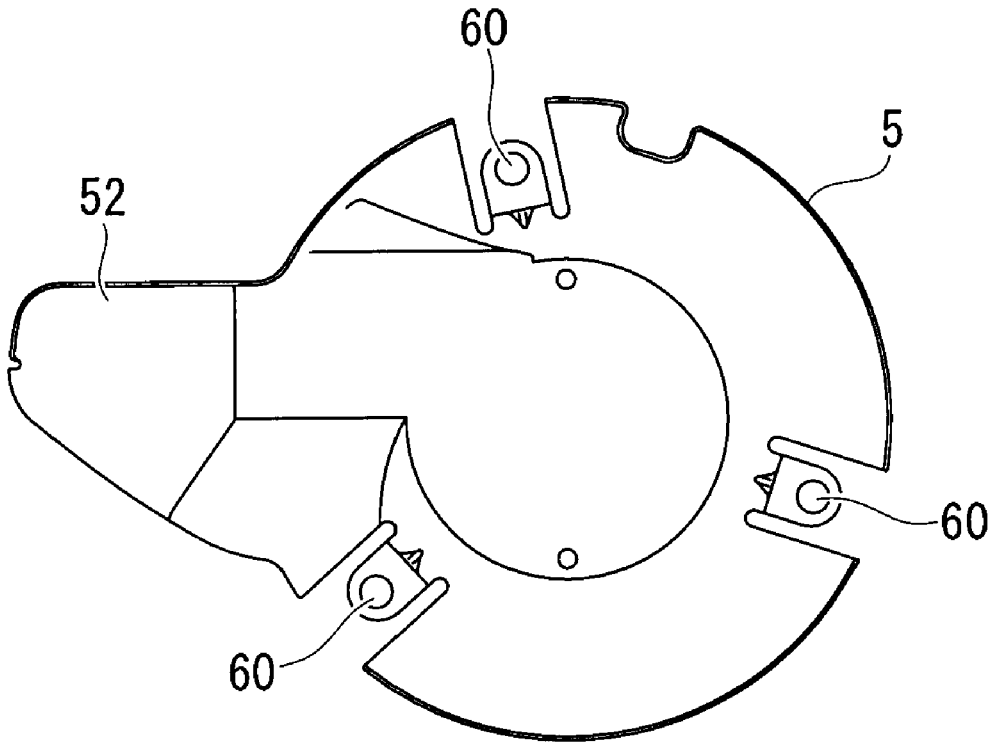
FIG. 8 is a side view of a heat shield panel according to an eighth embodiment of the present invention.

In this embodiment, as shown in FIG. 8, the positions of securing parts 60, that is, the positions of securing bolts, for the motor 3 and/or the heat shield panel 5 secured to and supported at the motor holding part 24 of the shroud 2 are provided at three locations closer to an inner circumference side than the outer circumference portion of the heat shield panel 5 and equally spaced on the circumference.

When the positions of the securing parts 60 (the positions of securing bolts) for securing the motor 3 and/or the heat shield panel 5 to the motor holding part 24 are provided at locations closer to the inner circumference side than the outer circumference portion of the heat shield panel 5 as described above, the securing parts 60 for the heat shield panel 5 itself, which is exposed to the heat source, and for the motor 3, which generates heat by itself, can be effectively cooled by cooling air guided to the inner face side of the heat shield panel 5.

Therefore, it is possible to reliably prevent the occurrence of problems and heat damage in cases where, for example, the positions of the motor 3 and the axial-flow fan 4 are shifted to interfere with the shroud 2, causing them to become unrotatable or damaged, because the securing bolts are loosened or the securing parts are thermally deformed or melted by external radiation heat and by self-heating.

Note that the present invention is not limited to the embodiments described above; appropriate modifications can be made without departing from the gist of the invention. For example, the fan-rotational-direction leading edge part 53, constituting the air guiding part 52 of the heat shield panel 5, does not need to be a strict arc shape; it may have a shape similar thereto. Of course, the fan-rotational-direction trailing edge part 54 of the air guiding part 52 may be a shape other than a straight shape.

The invention claimed is:

1. A fan motor comprising: a shroud which has an opening for letting air in and a motor holding part supported by a plurality of support struts at a center portion of the opening; a motor which is secured to and supported at the motor holding part of the shroud; an axial-flow fan which has a hub part connected to a rotation shaft part of the motor and has a plurality of fan blades on an outer circumference of the hub part; and a heat shield panel which is mounted at a rear side of the motor with a gap being provided therebetween, wherein the heat shield panel has a spatula-shaped air guiding part projecting outward in a radial direction, at least one location on an outer circumference portion thereof; and the air guiding part has a circumferential width gradually reduces in a radial direction toward an outer side and a fan-rotational-direction leading edge part which has an arc shape.

2. A fan motor according to claim 1, wherein the air guiding part has a fan-rotational-direction trailing edge part which has a straight shape.

3. A fan motor according to claim 1, wherein the fan-rotational-direction leading edge part of the air guiding part has a guide part bent toward an upstream side in an air flow direction, and the fan-rotational-direction trailing edge part of the air guiding part has a guide part bent toward a downstream side in the air flow direction.

4. A fan motor according to claim 1, wherein the air guiding part is provided at each of two or more locations on the outer circumference portion of the heat shield panel.

5. A fan motor according to claim 4, wherein a pitch angle of the air guiding part provided at each of two or more locations is set to a non-integer multiple of a pitch angle of the fan blades.

6. A fan motor according to claim 1, wherein the heat shield panel has an arc-shaped guide part bent toward a downstream side in the air flow direction, on an outer circumference edge portion, excluding the air guiding part.

7. A fan motor according to claim 1, wherein the heat shield panel has, on the outer circumference portion, a conical slope starting at a center portion of the heat shield panel toward a windward side in the air flow direction.

8. A fan motor according to claim 1, wherein the heat shield panel is mounted in a direction in which the fan-rotational-direction leading edge part, having the arc shape, of the air guiding part is disposed at a leading side of the axial-flow fan in a rotational direction thereof, and the fan-rotational-direction trailing edge part, having the straight shape, of the air guiding part is disposed at a trailing side of the axial-flow fan in a rotational direction thereof.

9. A fan motor according to claim 1, wherein the heat shield panel is mounted such that the air guiding part is disposed at a location where the air guiding part is overlapped with at least one of the support struts of the shroud.

10. A fan motor according to claim 1, wherein the heat shield panel is mounted such that the air guiding part is disposed between the support struts of the shroud.

11. A fan motor according to claim 1, wherein a securing part for the motor and/or the heat shield panel secured to and supported at the motor holding part is provided at a location closer to an inner circumference side than the outer circumference portion of the heat shield panel.

* * * * *